US006139427A

United States Patent [19]

Yi

[11] Patent Number: 6,139,427

[45] Date of Patent: Oct. 31, 2000

[54] VENTILATION SYSTEM

[75] Inventor: Seong-Hwan Yi, Seoul, Rep. of Korea

[73] Assignee: ECTA Co., Ltd., Seoul, Rep. of Korea

[21] Appl. No.: 09/200,318

[22] Filed: Nov. 25, 1998

[30] Foreign Application Priority Data

Dec. 24, 1997 [KR] Rep. of Korea ..... 97-72880
Apr. 11, 1998 [KR] Rep. of Korea ..... 98-13000

[51] Int. Cl.[7] ..... F24F 7/007

[52] U.S. Cl. ..... 454/329; 181/224; 181/225; 454/286; 454/906

[58] Field of Search ..... 454/252, 286, 454/305, 329, 338, 906; 181/224, 225

[56] References Cited

U.S. PATENT DOCUMENTS 2,697,163 12/1954 Spear ..... 454/338 X
5,554,071 9/1996 Peltola et al. ..... 454/338

FOREIGN PATENT DOCUMENTS 2 644 923 9/1990 France ..... 454/338
363152 12/1931 United Kingdom ..... 454/338

*Primary Examiner*—Harold Joyce
*Attorney, Agent, or Firm*—Ladas & Parry

[57] ABSTRACT

A ventilation system which provides a ventilating unit which can be installed without structural constraints, and air flow can be controlled effectively by setting the direction of nozzles in various directions and also can reduce the noise from air resistance. The system includes: a damper which is formed in the rear side of the ventilating unit and having barriers which are formed in up and down sides of the inner plane of the ventilating unit alternatively; a blower unit which is connected to the damper and a fan is installed centered by a hinge therein; an ejector which is connected to the blower unit so that the air from the fan of the blower unit is ejected through a nozzle body which is installed therein.

7 Claims, 13 Drawing Sheets

$R_{0.5}=r$, there $u=0.5\,u_0$ propagation angle $2\alpha=24°$

VENTILATION SYSTEM

TECHNICAL FIELD

The present invention relates to a ventilation system for large space such as underground parking lots, gymnasiums, and the likes and more particularly relates to providing a ventilation system without ducts so that the system can be installed without structural constraints and can regulate indoor air flow effectively.

BACKGROUND ART

It has been well known that the gases which are contained in exhaust gases of automobiles, for example nitrogen oxide ($NO_x$) gas and carbon monoxide (CO) gas, are very toxic, hence the gases should be ejected for health care.

Especially, in such places underground parking lots, while the gases are accumulated in some places, a ventilation system is required for ejecting the toxic gases and lowering the amount of the gas under the predetermined limit.

A ventilation system having ducts is an example of the existing ventilation system for ventilating such a large space.

However, in such a system, air flow is formed only between supply ports and exhaust ports of the system, hence the toxic gases may be accumulated in the place where is far away from the position the ports are installed.

In order to make up for the above shortcomings, it is required that the supply ports and the exhaust ports are installed more, then, the cost for the system runs higher as more ports are installed.

In addition, there is another shortcoming in such a system in that there are constraints in installing the ducts because in most cases there are many obstructive structures, such as large posts, ducts for cable, pipes for water suppling, and so on in the place where the system is installed.

In the meanwhile, in order to make up for the disadvantages of the ventilation system, a ventilation system without ducts has been disclosed in Japanese laid-open patent publication (No. 97-273785(HeiSei 9-273785) dated Oct. 21, 1997).

In the ventilation system, as shown in FIGS. 1, 2*a*, 2*b*, and 2*c*, a blower 3 is installed in a box shape ventilating unit 1, and inlets 4 and nozzles 5 are fixed rotatably in holes 7 at the side plane 6 of a chamber 2 by means of flanges 8 and lugs 9.

When the ventilating unit 1 is installed in underground parking lots, as shown in FIG. 1, the ventilating unit 1 is placed to face the inlet 4 of another ventilating unit 1 one after another in order to carry the air flow through the entire space.

But in such a system, while the direction of air jet can be controlled within very small degrees and outlets of the nozzles 5 are inclined from the center line of the nozzle, so the flow of air cannot be controlled in various directions, therefore, the system should be installed along straight line or close to the straight line.

Moreover, as shown in FIG. 2*c*, because the base of the nozzles 5 are installed vertically to the wall plane of the chamber 2, there is air resistance in nozzles 5 with the wall plane, therefore, the distance which air can reach is getting shorter and the noise from the air resistance occurs.

DISCLOSURE OF THE INVENTION

It is an objective of the present invention to provide a ventilation system without ducts, which has no constraints in installation layout and can lead air flow to exhaust port effectively because the direction of nozzles can be set in various directions.

Another objective of the present invention is to provide a ventilation system which can reduce the noise from air resistance in nozzles by forming the nozzle body having curved plane.

BEST MODE FOR CARRYING OUT THE INVENTION

The invention is now described in detail in the following, with reference to the accompanying figures, which show by way of examples some embodiments of installations in which the method according to the invention has been applied.

Figure 1:
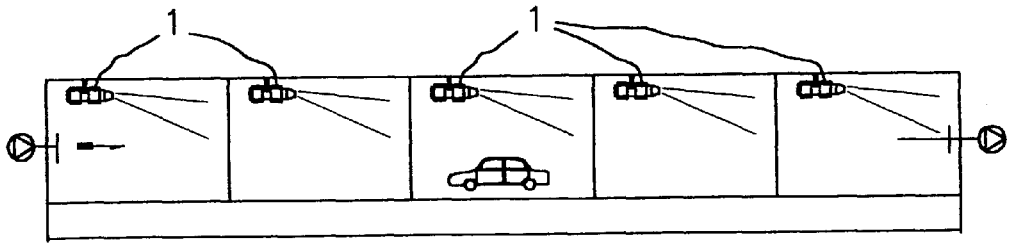
FIG. 1 PRIOR ART
FIG. 1 shows a schematic diagram of a typical ventilation system without ducts.
Figure 2A:
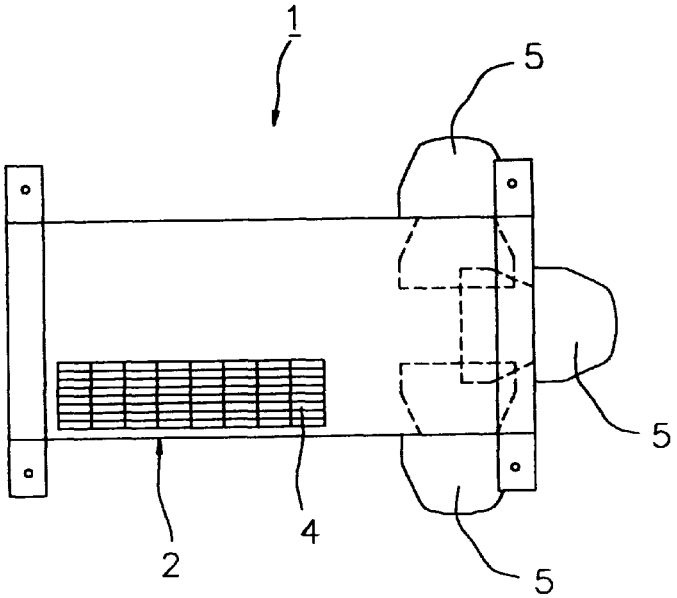
FIG. 2a PRIOR ART
FIG. 2*a* is a plane view showing the ventilating unit of prior art.
Figure 2B:
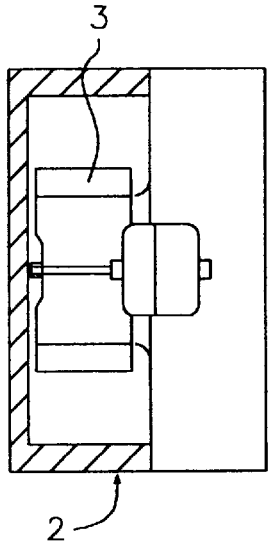
FIG. 2b PRIOR ART
FIG. 2*b* is a rear section view showing the ventilating unit of prior art.
Figure 2C:
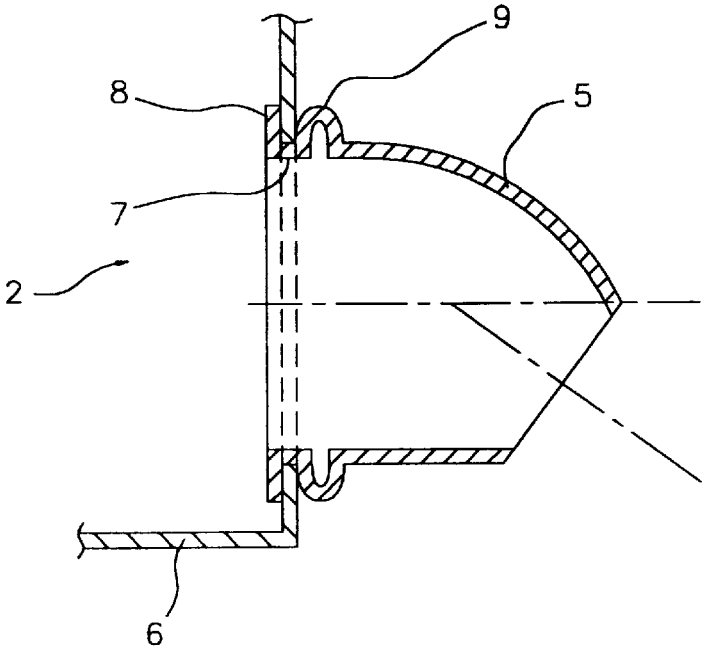
FIG. 2c PRIOR ART
FIG. 2*c* is a vertical section view showing the nozzle of the ventilating unit of prior art.
Figure 3:
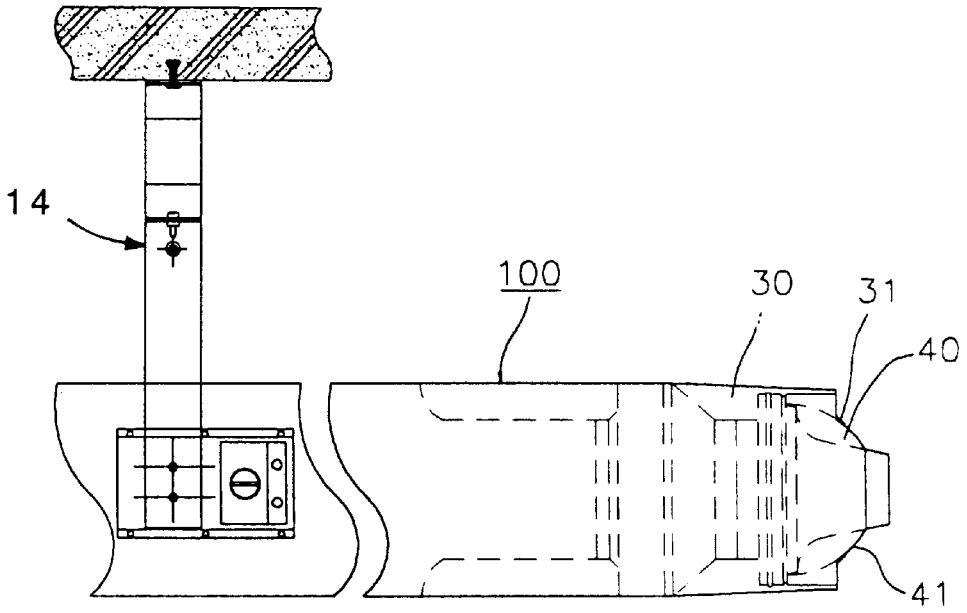
FIG. 3 is a side view of ventilating unit according to the present invention.
Figure 4A:
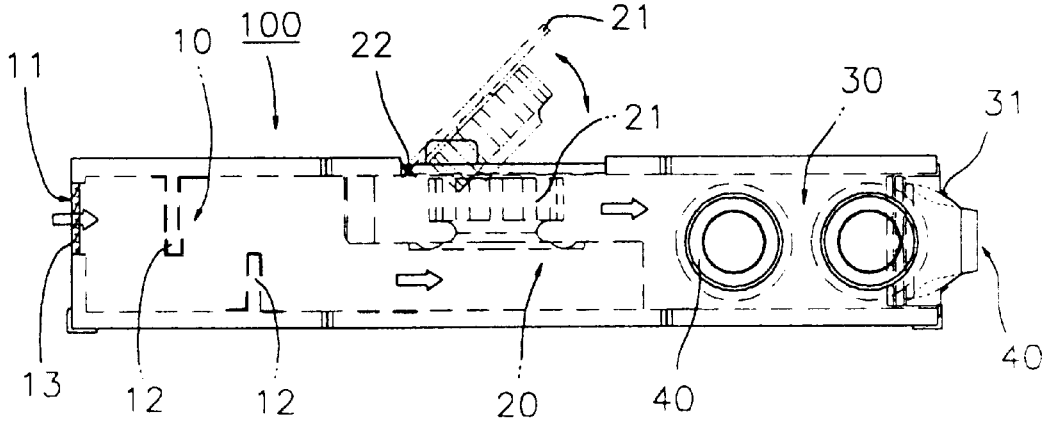
FIG. 4*a* is a front view of ventilating unit according to the present invention.
Figure 4B:
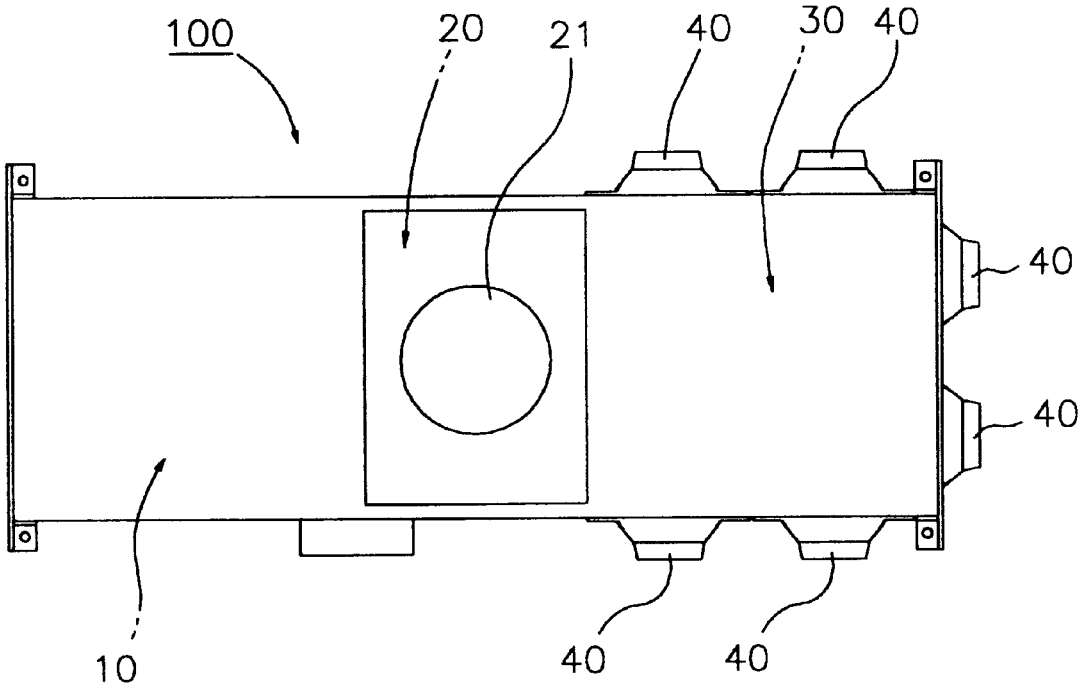
FIG. 4*b* is a plane view of ventilating unit according to the present invention.
Figure 5A:
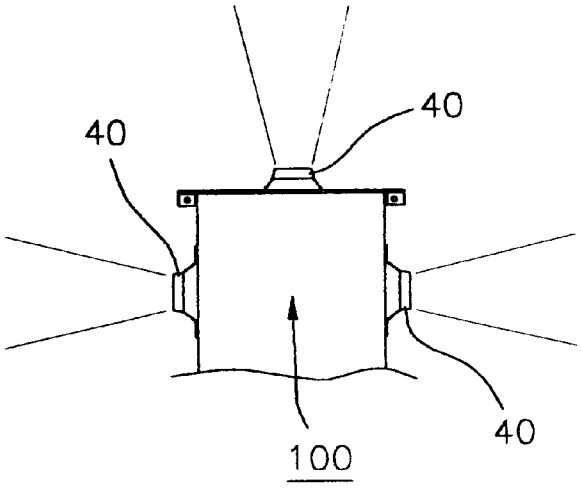
FIGS. 5*a*, 5*b*, 5*c*, and 5*d* show other embodiments of ventilating unit according to the present invention.
Figure 5B:
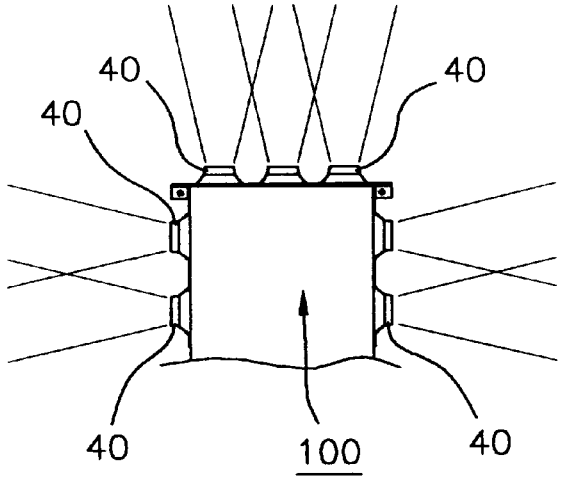
Figure 5C:
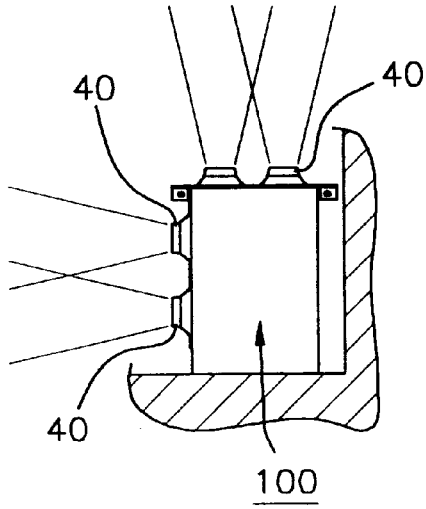
Figure 5D:
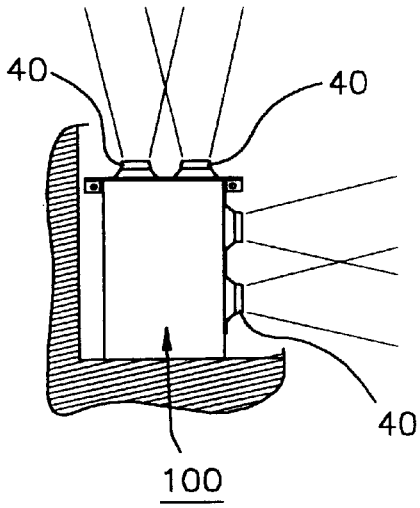

As shown in FIGS. 3, 4*a*, and 4*b*, a damper 10, a blower unit 20, and an ejector 30 are the ventilation unit being suspended from a ceiling with a member 14.

The damper 10, as shown in FIG. 4*a*, is designed to reduce the noise from air flow going through inlet 11 which is formed in the rear side of the ventilating unit 100.

The noise from the air flow through the inlet 11 is reduced in the process of going through passing barriers 12 which are formed in up and down sides of the inner plane of the ventilating unit 100 alternatively, and a filter is formed in the inlet 11 which filters the air from the outside.

Also, as shown in FIG. 4*a*, the blower unit 20 is connected to the damper 10, and a fan 21 is installed rotatably therein with being centered by a hinge 22, then, the fan 21 can be moved upward as shown by the arrow in FIG. 4*a*, so which makes it easy to clean or repair the ventilating unit 100.

The ejector 30 is connected to the blower unit 20, then, the air from the fan 21 of the blower unit 20 and from the inlet 11 can be ejected through a nozzle body 40.

One nozzle body 40 can be installed in the ejector 30, as shown in FIG. 3, or plural nozzle bodies 40 also can be installed in the ejector 30 according to the circumstance of installing position, as shown in FIGS. 5*a*, 5*b*, 5*c*, and 5*d*.

Figure 6A:
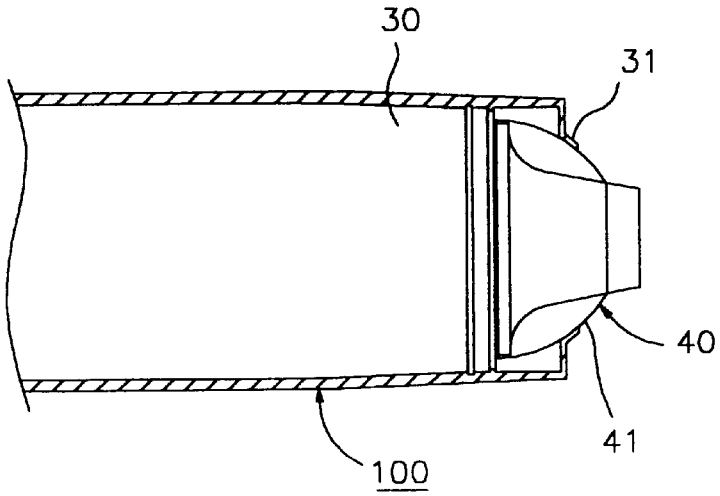
FIGS. 6*a*, 6*b*, and 6*c* show operating conditions of setting various direction of the nozzle according to the present invention.
Figure 6B:
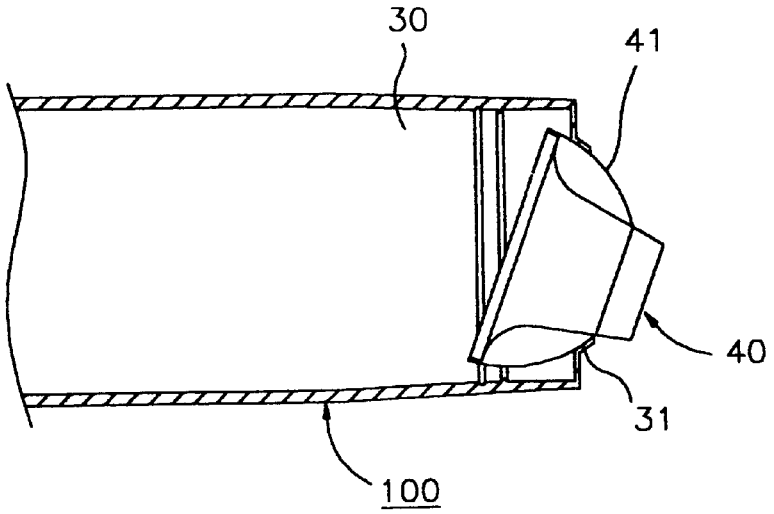
Figure 6C:
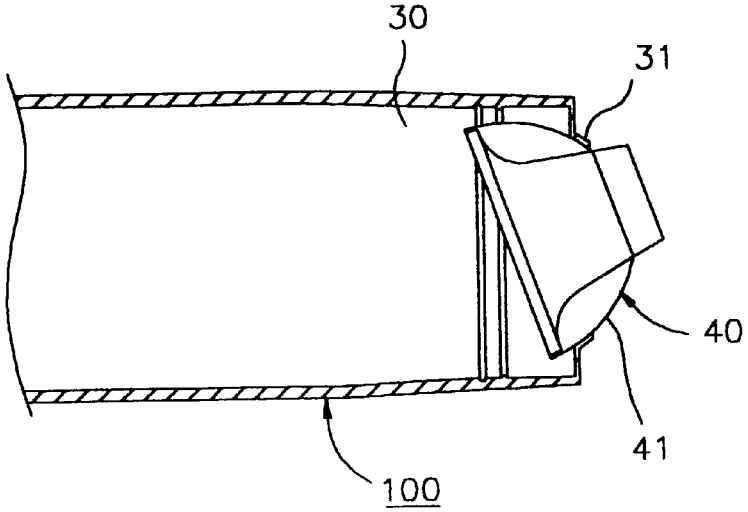

Also, a spherical shell 41 is formed in the outer plane of the nozzle body 40 as shown in FIGS. 6*a*, 6*b*, and 6*c*.

The nozzle body 40 is installed in spherical edge plane 31 of the ventilating unit 100 with contacting the spherical shell 41 slidably.

Also, as shown in FIGS. 7*a*, 7*b*, 7*c*, 8*a*, and 8*b*, two hinges 50 having spherical ends 51 are formed at opposite sides therein, whereby the spherical ends 51 of the hinges 50 are mounted on the step ring portion 101 slidably.

Figure 7A:
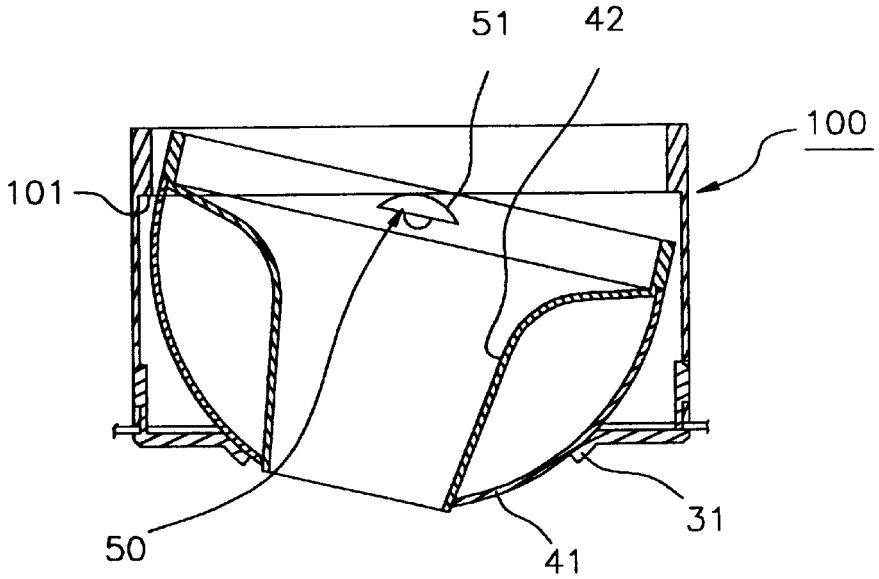
FIGS. 7*a*, 7*b*, and 7*c* are enlarged fragmentary section views showing operating condition of setting various direction of the nozzle of the present invention.
Figure 7B:
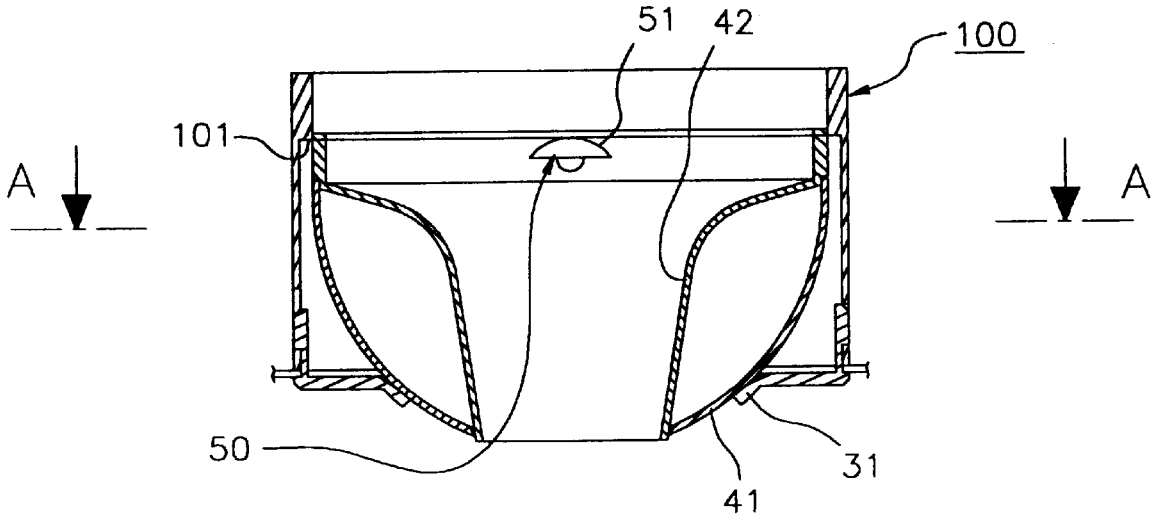
Figure 7C:
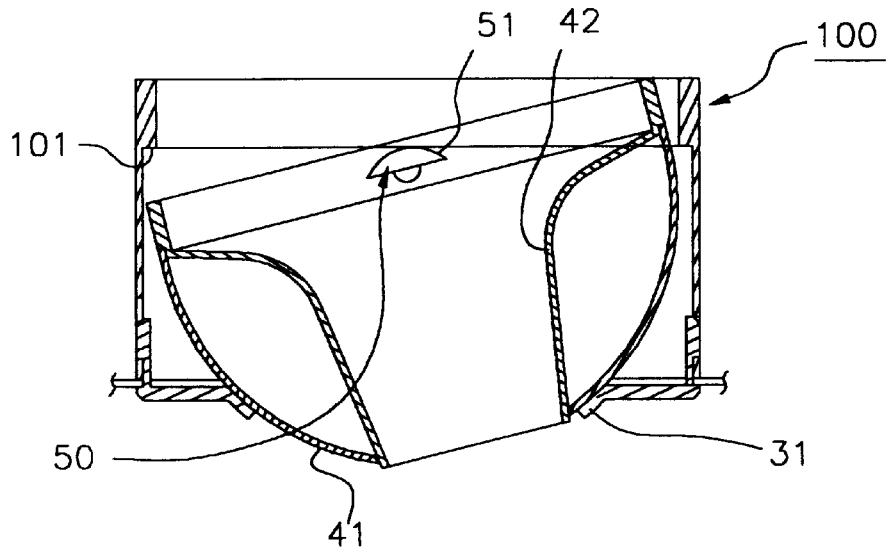

That is, as shown in FIGS. 7*a*, 7*b*, and 7*c*, the nozzle body 40 is fixed by inserting it from upper position of the ventilating unit 100 to the inside so that the nozzle body 40 is mounted in spherical edge plane 31 slidably, and the contacting position of the hinges 50 of the nozzle body 40 is to be placed in the step ring portion 101 of the ventilating unit 100.

Figure 8A:
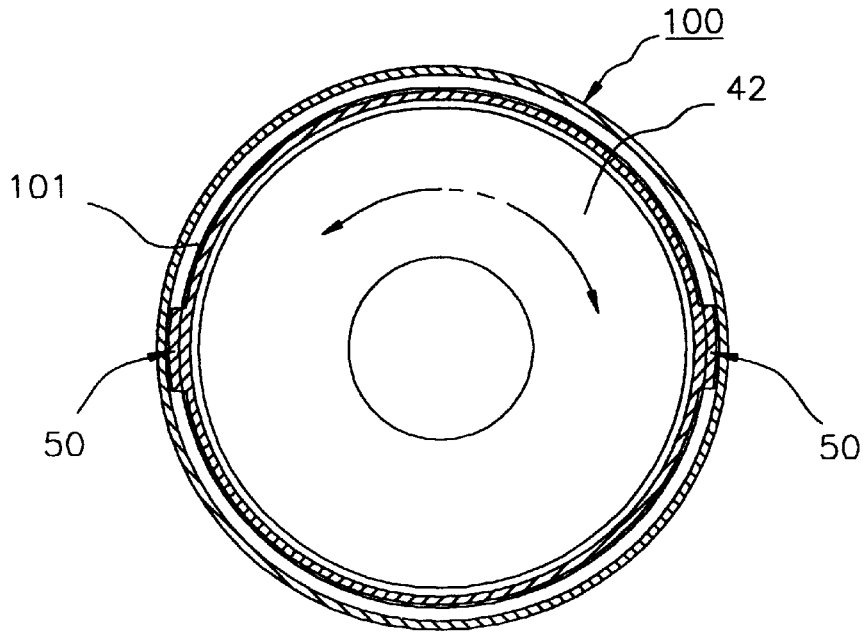
FIGS. 8*a* and 8*b* are section views taken in the line A—A of FIG. 7*b*.
Figure 8B:
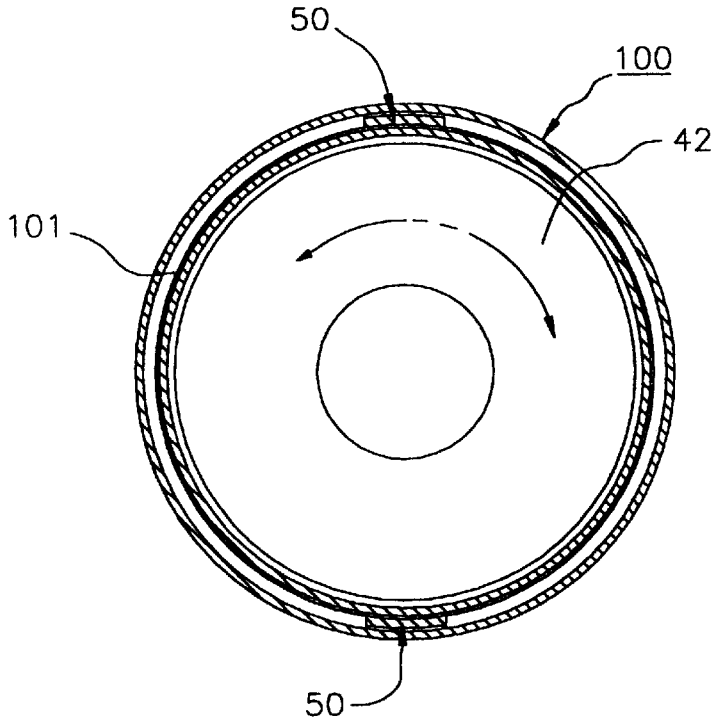

Therefore, the nozzle body 40 can be rotated with respect to the ventilating unit 100 as shown by arrow in FIGS. 8*a* and 8*b*.

Also, as shown in FIGS. 7*a*, 7*b*, and 7*c*, the direction of nozzle body 40 can be varied in various directions with respect to the center line of ventilating unit 100 because the spherical shell 41 of the nozzle body 40 is fixed in spherical edge plane 31 of the ejector 30.

And the inner surface of the nozzle body 40 is formed having a curved plane so that the air flow through therein is smooth and the vibration of the nozzle body 40 or the ventilating unit 100 is prevented.

In the meanwhile, the effectiveness of aforesaid ventilation system can be verified by following equations.

In a room supplied with a ventilation system, in order to getting effective ventilation of the dwelling zone, a certain impulse per unit of length (depth L of the room) is always required as follows:

$$I = \int_0^A \frac{u^2}{L}\, dA \tag{1}$$

where necessary supply air impulse may be in conflict with the permissible speed in the dwelling zone of, for example, 0.2 m/s.

Figure 9A:
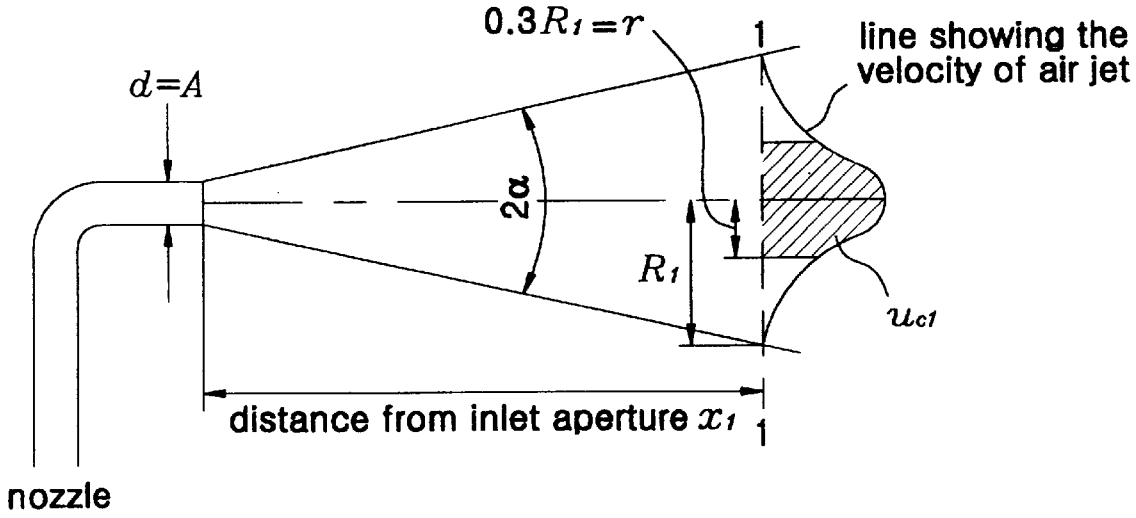
FIGS. 9*a* and 9*b* show schematic diagrams of an air jet profile of the nozzle according to the present invention.
Figure 9B:
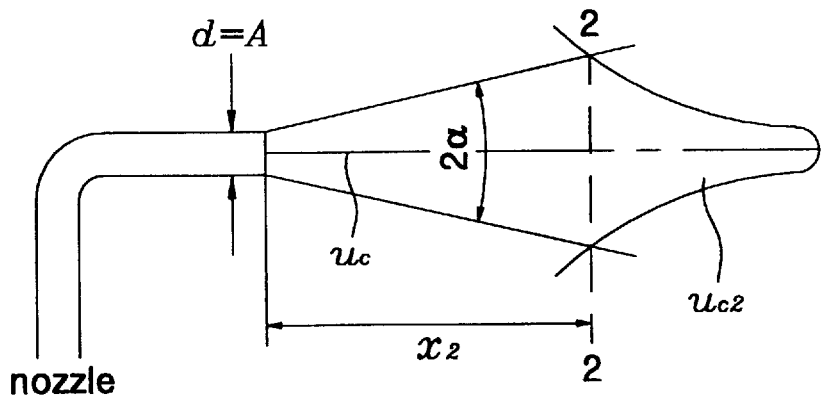
Figure 10A:
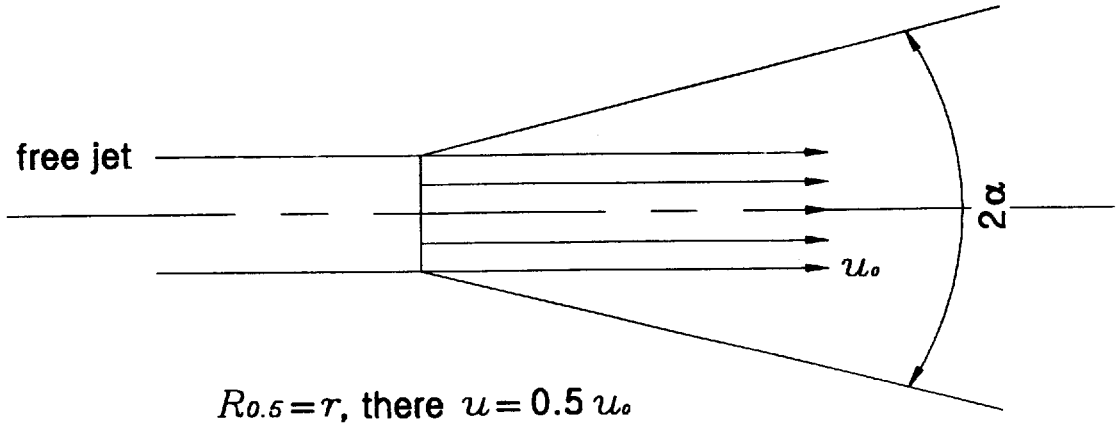
FIGS. 10*a* and 10*b* show schematic diagrams of a free air jet speed profile of the nozzle according to the present invention.
Figure 10B:
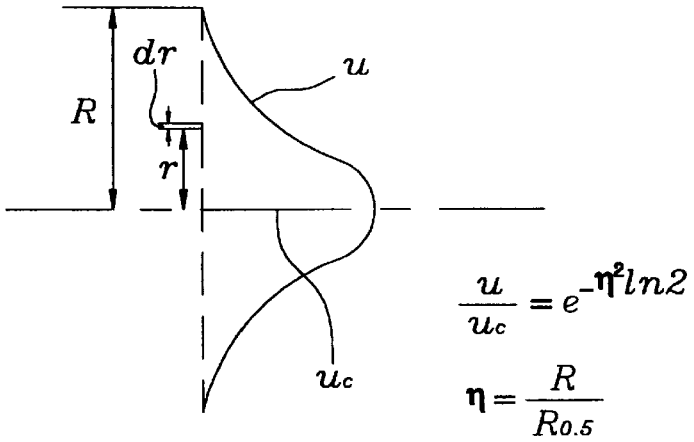

In the following equations with reference to the accompanying FIGS. 9*a*, 9*b*, and 10, the following definitions are used:

| | |
|---|---|
| L: depth of room | u, $u_{c1}$, $u_{c2}$: the speed of fluid in the center of the nozzle |
| $R_1$, $R_2$, r: radius | A, $A_0$: area |
| g: the constant of the acceleration of gravity | $u_i$: the speed of entering ventilation jet |

-continued

| | |
|---|---|
| $u_0$: the speed of air jet in the nozzle | T: indoor temperature |
| $\eta$: $R/R_{0.5}$ | d: the diameter of the nozzle |
| $\phi$, $\alpha$: the angle of air jet | $q_m$: mass flow |
| $\rho$: density | $x_1$, $x_2$: the distance of jet reaching |

First, the mass flow in section 1 in FIG. 9*a* can be expressed as follows:

$$q_{m1} = \int_0^\infty \int_0^{2\pi} \rho u_{c_1} \cdot e^{-\eta^2 \ln 2} \cdot r\, dr\, d\phi \tag{2}$$

Also, the impulse in the section 1 is expressed as follows:

$$\begin{aligned} I_1 &= \int_0^\infty \int_0^{2\pi} \rho u_{c_1}^2 \cdot e^{-2\eta^2 \ln 2} \cdot r\, dr\, d\phi \\ &= \int_0^A \rho u_i^2 \cdot dA \end{aligned} \tag{3}$$

The width of air jet can be evaluated by following formula:

$$R_1 = \int_0^{x_1} Tg\alpha\, dx_1 \tag{4}$$

Where the mass flow in section 1 is 0.3 times larger than the jet distance, which is equal to 50% of the mass flow of linear constant speed, and the left 50% of the mass flow diffuse to room with the propagation angle $\alpha$, 12°.

The mass flow in the section 2 in FIG. 9*b* can be expressed as follows:

$$\begin{aligned} q_{m2} &= \int_0^\infty \int_0^{2\pi} \rho u_{c_2} \cdot e^{-\eta^2 \ln 2} \cdot r\, dr\, d\phi \\ &\approx \frac{1}{2} \int_0^\infty \int_0^{2\pi} \rho u_{c_1}^2 \cdot e^{-\eta^2 \ln 2} \cdot r\, dr\, d\phi \end{aligned} \tag{5}$$

Also, the impulse in the section 2 is as follows:

$$\begin{aligned} I_2 &= \int_0^\infty \int_0^{2\pi} \rho u_{c_2} \cdot e^{-2\eta^2 \ln 2} \cdot r\, dr\, d\phi \\ &\approx \frac{1}{2} \int_0^\infty \int_0^{2\pi} \rho u_{c_1}^2 \cdot e^{-2\eta \ln 2} \cdot r\, dr\, d\phi + \int_0^A \rho u_0^2 \cdot dA \end{aligned} \tag{6}$$

The width of the air jet can be evaluated by following formula:

$$R_2 = \int_0^{x_2} Tg\alpha\, dx_2 \tag{7}$$

In case of the free air jet, we can easily extract jet width, influx, and so on with respect to the distance x by using the formulae from (1) to (7), because the angle of air jet is constant.

Figure 11:
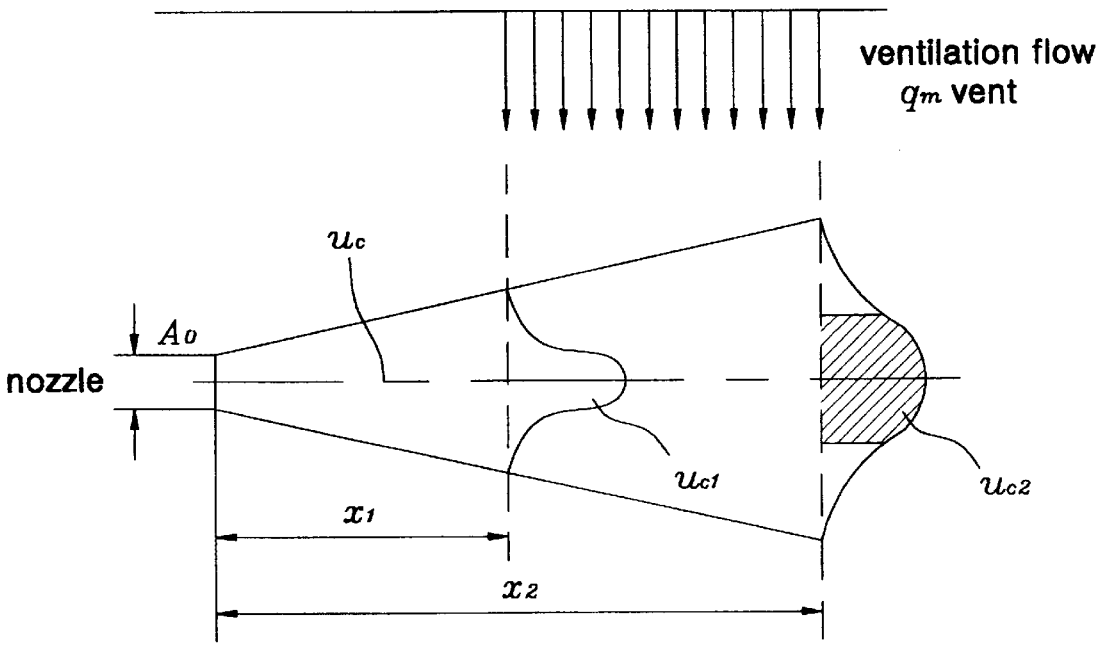
FIG. 11 shows a schematic diagram of an air jet profile of the direction of the free air jet according to the present invention.

But in the case where the structure of the chamber is complex, for example, in the case of an interfering or accumulated air flow, if we set the air flow as in FIG. 11, then we can get effective ventilation.

That can be shown by following formulae:

$$u_{c_1} = C \cdot \frac{x_1}{\sqrt{A_0}} \cdot u_0,\ C \approx 6 \tag{8}$$

Impulse balance can be expressed as follows:

$$\int_0^\infty \int_0^{2\pi} \rho u_{c_1}^2 \cdot e^{-2\eta^2 \ln 2} \cdot r\,dr\,d\phi = \int_0^\infty \int_0^{2\pi} \rho u_{c_2}^2 \cdot e^{-2\eta^2 \ln 2} \cdot r\,dr\,d\phi \tag{9}$$

And continuity equation is:

$$\int_0^\infty \int_0^{2\pi} \rho u_{c_1} \cdot e^{-\eta^2 \ln 2} \cdot r\,dr\,d\phi = \int_0^\infty \int_0^{2\pi} \rho u_{c_1} \cdot e^{-\eta^2 \ln 2} \cdot r\,dr\,d\phi + q_m \tag{10}$$

So the speed of air jet is retarded as follows:

$$\frac{u_x}{u_i} = 4.5 \times \frac{d}{x} \tag{11}$$

where $u_x$ is the speed at the distance x.

And the air mass flow induced by the nozzle can be obtained by using following formulae, and the formulae are to be used with the assumption that the air jet is influenced by the structure of the space, cars, and other obstacles:

$$\frac{q_{mx}}{q_{mi}} = 0.2 \times \frac{x}{d} \tag{12}$$

where $q_{mx}$ is air influx at the distance x, and $q_{mi}$ is air jet mass flow in the nozzle.

On the other hand, the air mass flow at the nozzle in free space is as follows:

$$\frac{q_{mx}}{q_{mi}} = \frac{2}{6.0} \times \frac{x}{d} = 0.33 \times \frac{x}{d} \tag{13}$$

Figure 12:
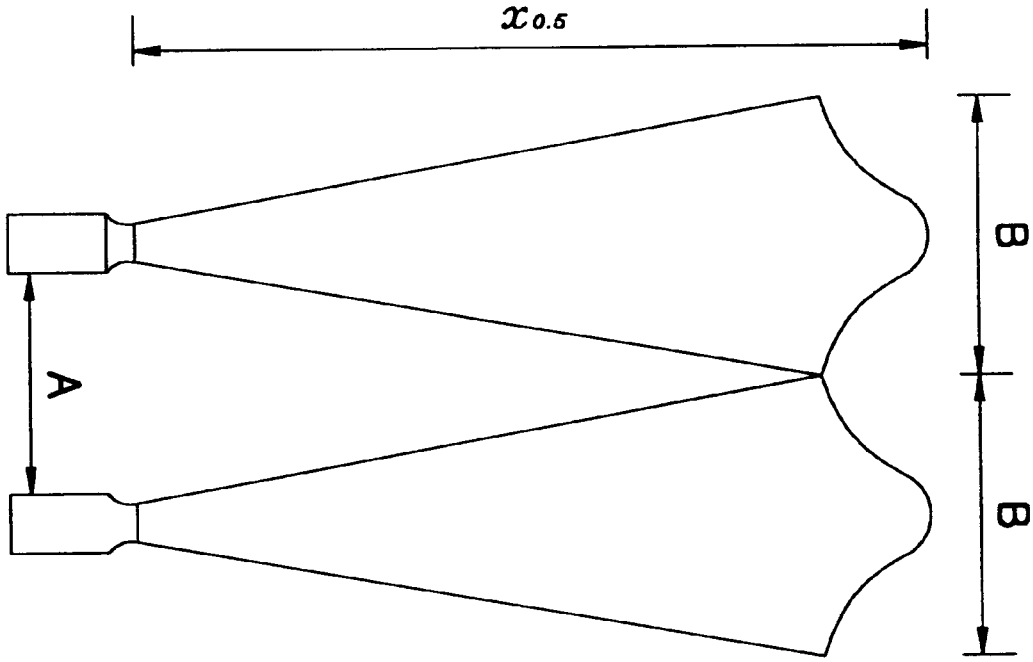
FIG. 12 shows a schematic diagram of an air jet profile by two nozzles according to another embodiment of the present invention.

The change of speed at the center of the nozzle in case two nozzles installed as shown in FIG. 12 is shown by following formula (14), and the correction coefficient k can be obtained by the formula (4).

$$\frac{u_x}{u_i} = k \times 4.5 \times \frac{d}{x} \tag{14}$$

Also, the change of the distances which air can reach, the air mass flow in case more than two nozzles are installed, and the change of the air jet in the same direction can be shown by following formulae:

$$\frac{u_x}{u_i} = \sqrt{n} \times 4.5 \times \frac{d}{x} \tag{15}$$

$$\frac{q_{mx}}{q_{mi}} = \sqrt{n} \times 0.2 \times \frac{x}{d} \tag{16}$$

where n is the number of nozzles.

As we have mentioned above, by using the formulae, we can evaluate the radius of the nozzle, also improve the installing convenience by making it possible to jet in various direction through the nozzle, therefore, harmonious air jet can be possible.

Industrial Applicability

As described above, a ventilation system for large space such as underground parking lots and the likes according to the present invention which has no constraints in installation layouts because of without ducts and can lead air flow to exhaust port effectively by setting the nozzles in various directions, and can reduce noise in the nozzle by making the nozzle having curved plane.

What is claimed is:

1. A ventilation system comprising:

a ventilation unit adapted to be suspended a distance from the ceiling of an indoor space, the ventilation unit including:

a damper, which is formed, in a section of a ventilating unit which is near the air intake of the ventilation unit, by at least one barrier projecting in a first direction from an inside surface of the ventilating unit and at least one barrier projecting in a second direction from the inside surface of the ventilating unit;

an ejector which is located in a section of the ventilating unit which is near an air outlet of the ventilation unit, the ejector having at least one nozzle body attached thereto;

a blower unit which is installed near the upper central section of the ventilating unit, between the damper and the ejector, the blower unit being secured to the ventilation unit with a hinge on one side of the blower unit, thereby allowing the blower unit to be opened outwardly, the blower unit being disposed, during operation, in a plane which is parallel to the top and bottom surfaces of the ventilating unit, the blowing unit creating an air flow in a direction which is parallel to the top and bottom surfaces of the ventilation unit;

a member for connecting the ventilation unit to the ceiling.

2. The ventilation system of claim 1, wherein the outer surface of the at least one nozzle body is spherical, whereby to be slidably and rotatably mounted to the ejector, the ejector having at least one spherical end portion.

3. The ventilation system of claim 2, wherein the outer surface of the at least one nozzle body comprises two hinges having spherical ends, said hinges being mounted on the large circular end the outer surface of the at least one nozzle body, said hinges being diametrically opposed to one another, the spherical ends of the hinges being slidably and rotatably mounted to a step ring portion of the ventilation unit.

4. A ventilation apparatus for transporting a gas from a first location in an indoor space to a second location in the same indoor space, the ventilation apparatus having no ducts between the first and second locations, the ventilation apparatus comprising a plurality of ventilation systems, each ventilation system comprising:

a ventilation unit suspended a distance from the ceiling of an indoor space, the ventilation unit comprising:

a damper, which is formed, in the section of a ventilating unit which is near the air intake of the ventilation unit, by at least one barrier vertically ascending from the inside bottom surface of the ventilating unit and at least one barrier vertically descending from the inside top surface of the ventilating unit;

an ejector which is located in the section of the ventilating unit which is near the air outlet of the ventilation unit, the ejector having at least one nozzle body attached thereto;

a blower unit which is installed near the upper central section of the ventilating unit, between the damper and the ejector, the blower unit being secured to the ventilation unit with a hinge on one side of the blower unit, thereby allowing to open the blower unit outwardly, the blower unit being disposed, during operation, in a plane which is parallel to the top and bottom surfaces of the ventilating unit, the blowing unit creating an air flow in a direction which is parallel to the top and bottom surfaces of the ventilation unit;

a member connecting the ventilation unit to the ceiling.

5. The ventilation apparatus of claim 4, wherein, for at least one ventilation system, the outer surface of the at least one nozzle body is spherical, whereby to be slidably and rotatably mounted to the ejector, the ejector having at least one spherical end portion.

6. The ventilation apparatus of claim 5, wherein, for at least one ventilation system, the outer surface of the at least one nozzle body comprises two hinges having spherical ends, said hinges being mounted on the large circular end the outer surface of the at least one nozzle body, said hinges being diametrically opposed to one another, the spherical ends of the hinges being slidably and rotatably mounted to a step ring portion of the ventilation unit.

7. A method of transporting a gas from a first location in an indoor space to a second location in the same indoor space, without the use of ducts, the method comprising the steps of creating an air flow from the first location to an at least one intermediate location and creating an air flow from the at least one intermediate location to the second location.

* * * * *